US009463501B2

(12) United States Patent
Yamano et al.

(10) Patent No.: US 9,463,501 B2
(45) Date of Patent: Oct. 11, 2016

(54) PRESS FORMING METHOD FOR STEEL PLATE

(75) Inventors: Takayuki Yamano, Kakogawa (JP); Jiro Iwaya, Kakogawa (JP); Takayuki Kimura, Kakogawa (JP); Tatsuya Asai, Kakogawa (JP); Naoki Mizuta, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 601 days.

(21) Appl. No.: 13/995,009

(22) PCT Filed: Jan. 12, 2012

(86) PCT No.: PCT/JP2012/050453

§ 371 (c)(1),
(2), (4) Date: Jun. 17, 2013

(87) PCT Pub. No.: WO2012/096336

PCT Pub. Date: Jul. 19, 2012

(65) Prior Publication Data

US 2013/0263637 A1 Oct. 10, 2013

(30) Foreign Application Priority Data

Jan. 14, 2011 (JP) ..... 2011-006387
Jan. 14, 2011 (JP) ..... 2011-006388

(51) Int. Cl.
*B21D 22/20* (2006.01)
*B21D 22/24* (2006.01)

(52) U.S. Cl.
CPC ..... *B21D 22/20* (2013.01); *B21D 22/208* (2013.01); *B21D 22/24* (2013.01)

(58) Field of Classification Search
CPC .... B21D 22/20; B21D 22/208; B21D 22/24; B21D 22/26; B21D 24/16; C21D 9/48
See application file for complete search history.

(56) References Cited

U.S. PATENT DOCUMENTS

2002/0170177 A1 11/2002 Koyama et al.
2006/0200990 A1 9/2006 Koyama et al.

(Continued)

FOREIGN PATENT DOCUMENTS

CN 101054003 A 10/2007
JP 02-030331 A 1/1990

(Continued)

OTHER PUBLICATIONS

Komiya, Y., "The Latest Trends in Steel Products for Automobiles," R&D Kobe Steel Engineering Reports, vol. 52, No. 3, pp. 2-5, (Dec. 2002) (with partial English translation).

(Continued)

*Primary Examiner* — Debra Sullivan
(74) *Attorney, Agent, or Firm* — Oblon, McClelland, Maier & Neustadt, L.L.P.

(57) ABSTRACT

A press forming method forming an extended part by extension in a later forming period after deep drawing, the deep drawing process carried out with working at 100-250° C., and the extension forming process carried out colder at less than 50° C., whereby the extended part is formed by extension in a cup shaped low parts formed by deep drawing. Thus, press forming products containing formed elements can be deep drawing formed and extension formed at a high forming rate of 10 mm/sec or greater, which can assure high productivity. By making a steel plate temperature 100-350° C. during press forming and by making the forming rate in the later forming period where extension forming is carried out slower than the forming rate in an earlier forming period where extension forming is not carried out, cracking of the extended part can be prevented and press forming limitations can be improved.

7 Claims, 9 Drawing Sheets

(56) References Cited

U.S. PATENT DOCUMENTS

| | | | |
|---|---|---|---|
| 2007/0240479 | A1 | 10/2007 | Nagai et al. |
| 2010/0275670 | A1 | 11/2010 | Nagai et al. |

FOREIGN PATENT DOCUMENTS

| | | | |
|---|---|---|---|
| JP | 8 155558 | | 6/1996 |
| JP | 11-309519 | A | 11/1999 |
| JP | 2001 246427 | | 9/2001 |
| JP | 2002-143935 | A | 5/2002 |
| JP | 2002 331326 | | 11/2002 |
| JP | 2004-190050 | A | 7/2004 |
| JP | 2005-138112 | A | 6/2005 |
| JP | 2007 111765 | | 5/2007 |
| JP | 2008-307092 | A | 12/2008 |
| JP | 2009 113058 | | 5/2009 |
| JP | 2010 188393 | | 9/2010 |

OTHER PUBLICATIONS

Kasuya, K., et al., "Effect of Alloying Elements and Annealing Conditions on Tensile Properties of TRIP-Aided Steel Sheet with Bainitic Ferrite Matrix," R&D Kobe Steel Engineering Reports, vol. 57, No. 2, pp. 27-30, (Aug. 2007) (with partial English translation).

Sugimoto, K., et al., "Warm Formability of Ultra High-Strength Low Alloy TRIP-aided Sheet Steels with Bainitic Ferrite Matrix," Tetsu-to-Hagane, vol. 91, No. 2, pp. 34-40, (Feb. 2005) (with partial English translation).

International Search Report Issued Apr. 10, 2012 in PCT/JP12/050453 Filed Jan. 12, 2012.

Partial English translation of Koh-ichi Sugimoto et al, Warm Formability of Ultra High-Strength Low Alloy TRIP-aided Sheet Steels with Bainitic Ferrite Matrix, Tetsu-to-Hagane (Iron and Steel), vol. 91, No. 2, 2005.

(a)

(b)

PRESS FORMING METHOD FOR STEEL PLATE

TECHNICAL FIELD

The present invention relates to a press forming method for a steel plate, which may be a steel sheet.

BACKGROUND ART

Press-formed members of automobiles and others have various shapes. In press forming for these members, plural forming elements are generally combined with each other, examples of the elements include deep drawing, bulging, stretch flanging, and bending. A member difficult to press-form, out of these members, is, for example, a member such as a door inner illustrated in FIG. 8, which has, in the bottom of its body, bulged regions A in a convex or convex form. About this member, the bulged regions A are formed by bulging at the late stage of deep drawing therefor. Examples of a press-formed member of such a type include, besides door inners, door outers, front pillars, center pillars, rear floors, and side sills. Deep drawing is a method of causing a material to flow into a die so as to be formed, and bulging is a method of extending a material in a die so as to be formed.

Usually, in press factories for producing these members, press forming is performed at a high forming velocity of 10 mm/sec or more to ensure high productivity. In press factories for automobile members, which pursue high productivity, press forming is performed at a high forming velocity of about 70 mm/sec in many cases. The forming velocity referred to herein is an average forming velocity during a period from a time when a punch contacts a blank so as to start an actual forming of the blank to an end of the forming.

In the automobile field in recent years, in order to improve automobiles in mileage to reduce the discharge of carbon dioxide, attempts to use high tensile steel plates for their press-formed members have been positively advanced for lightening their bodies. For a part of press-formed members, high tensile steel plates having a tensile strength of 980 MPa or higher have come to be used.

It is well known that as a steel plate is increased in strength, the ductility thereof is decreased. The press formability thereof is also decreased. Thus, in order that steel plates higher in strength can be applied to wider-spreading press-formed members, from the viewpoint of the material thereof, developments have been advanced about high tensile steel plates good in balance between strength and ductility. From the viewpoint of the working technique thereof, developments have been advanced about a press forming method for improving the limit of press forming.

Example of a high tensile steel plate good in balance between strength and ductility that has been so far developed include DP (dual phase) steel plates, which are composed of a ferrite phase and a martensite phase, and TRIP (transformation induced plasticity) type steel plates having retained austenite transformation induced plasticity (see, for example, Non Patent Literature 1). Recently, as a high tensile steel plate better in balance between strength and ductility, developments have been made also about a TBF (trip aided bainitic ferrite) steel plate of a TRIP type, which has bainitic ferrite as a parent phase (see, for example, Non Patent Literature 2).

As the press forming method for improving the limit of press forming, suggested are a method of press-forming a steel plate under conditions that the steel plate temperature at its punch region is set to normal temperature or lower and the steel plate temperature at its crease press region to 150° C. or higher (see, for example, Patent Literature 1), and a method of press-forming a TRIP type steel plate under conditions that the temperature of a mold at its die shoulder region is set into the range of 150 to 200° C., and that of the mold at its punch shoulder region into the range of −30 to 0° C. (see, for example, Patent Literature 2). In each of the methods described in Patent Literatures 1 and 2, deep drawing is performed to verify an advantageous effect of improving the deep drawing limit on the basis of local warm forming at a crease pressing region or die shoulder region.

Reports are also made about test results that individual tests were made in which TBF steel plates were used to examine the effect of temperature for forming the steel plates onto the press formabilities (bulgability, deep drawability and stretch flangability) to find out that there is a warm temperature range in which the bulgability, deep drawability and stretch flangability are made better than those in any cold temperature range (see, for example, Non Patent Literature 3). In the formation described in Non Patent Literature 3, the bulging tests and stretch flanging tests were made at a considerably lower forming velocity, 1 mm/min (0.017 mm/sec), than forming velocities in actual press factories, about 70 mm/sec. The deep drawing tests were made at a forming velocity of 200 mm/min (3.3 mm/sec).

CITATION LIST

Patent Literatures

[Patent literature 1] JP 2001-246427A
[Patent literature 2] JP 2007-111765A

Non Patent Literatures

[Non Patent Literature 1] Yukihisa Komiya, "Present State and Trend of Steel Material for Automobiles", R & D, Kobe Steel Engineering Report, Kobe Steel Ltd., Vol. 52, No. 3 (December, 2002), pp. 2-5
[Non Patent Literature 2] Kohji Kasuya, and Yohichi Mukai, "Effects of Alloy Elements and Annealing Conditions onto Mechanical Properties of TRIP Type Bainitic Ferrite Steel Plate", R & D, Kobe Steel Engineering Report, Kobe Steel Ltd., Vol. 57, No. 2 (August, 2007), pp. 27-30
[Non Patent Literature 3] Kohichi Sugimoto, "Warm Formability of Ultrahigh Tensile Low Alloy TRIP Type Bainitic Ferrite Steel Plate", Iron and Steel, Vol. 91, No. 2 (February, 2005), pp. 34-40

SUMMARY OF INVENTION

Solution to Problem

In the above-mentioned press-formed members involved in forming elements of deep drawing and bulging, their bulged region obtained by the bulging is cracked in many cases. Thus, it is desired that the members are improved in press formability. The crack of the bulged region is more easily generated as the steel plate is higher in strength. This matter is a cause for hindering the press-formed members from being made high in strength.

About the door inner illustrated in FIG. 8 or such a press-formed member, in which the bottom of its body has a bulged region and the bulged region is obtained by bulging at the late stage of deep drawing, it is difficult that the member is obtained by using a high tensile steel plate and press-forming this plate. In the actual situations, an improvement in the strength of steel plates to be used has not been advanced very much.

In order to improve press forming performance for such a press-formed member involved in forming elements of deep drawing and bulging, and further promote an increase in the strength of steel plates to be used for such a press-formed member, it is conceivable to use a warm forming method as described in Patent Literatures 1 and 2, and Non Patent Literature 3. However, no report has been made about an example of warm-forming a steel plate into such a member at a forming velocity of 10 mm/sec or more, which can give a high productivity. The present inventors have verified that as will be described as Comparative Examples in Table 7(a) and 7(b), such a press-formed member cannot be obtained by warm forming at a high forming velocity (70 mm/sec) even when a high tensile steel plate good in balance between strength and ductility is used.

Thus, a first object of the present invention is to make it possible to obtain a press-formed member involved in forming elements of deep drawing and bulging by press forming at a high forming velocity of 10 mm/sec or more, which can ensure high productivity.

A second object of the invention is to make it possible to press-form a high tensile steel plate into a press-formed member involved in deep drawing and bulging while a decline in the productivity thereof is restrained.

Solution to Problem

In order to attain the first object, a first aspect of the invention adopts a press forming method, for a steel plate, including at least one deep drawing step and at least one bulging step, the forming velocity for the press forming in each of these forming steps being set to 10 mm/sec or more, wherein the deep drawing step, which is at least one in number, is performed by warm working in a warm temperature range of 100 to 250° C., and the bulging step, which is at least one in number, is performed by cold working in a cold temperature range lower than 50° C.

In order to attain the second object, a second aspect of the invention adopts a press forming method for a steel plate, including performing bulging at a late forming stage of deep drawing, wherein the temperature of the steel plate is set into the range of 100 to 350° C. while the steel plate is press-formed, and the forming velocity at the late forming stage for performing the bulging is made lower than the forming velocity at an earlier forming stage in which no bulging is performed.

The present inventors have used a cylindrical punch and a die to make a deep drawing test and a bulging test under conditions that the temperature of steel plates and the forming velocity thereof are varied. Sampled blanks have been rendered 980-MPa-class TBF steel plates having a plate thickness of 1.4 mm. In the bulging test, the diameter of the blanks have been made large and further crease pressing force thereon have been made large in such a manner that the material has not flowed into the die. Conditions for the tests are as follows:

(Test Conditions)

Punch diameter: 50 mm (shoulder radius: 5 mm)

Die diameter: 54 mm (shoulder radius: 7 mm)

Blank diameter: 105 mm (deep drawing test), and 150 mm (bulging test)

Crease pressing force: 12 tonf (deep drawing test), and 20 tonf (bulging test)

Steel plate temperature: 20 to 350° C.

Forming velocities: 0.1 mm/sec, 5 mm/sec, 10 mm/sec, and 70 mm/sec

FIGS. 9(*a*) and 9(*b*) show results of the drawing test, and ones of the bulging test, respectively. According to these test results, in the deep drawing test, the effect of the forming velocity is hardly recognized, and in a warm temperature range of 100 to 250° C., the forming ultimate height is made better than in a cold temperature of room temperature. In the meantime, about the bulging test, at a low forming velocity of 0.1 mm/sec, the forming ultimate height is not lowered very much even when the steel plate temperature is made high. In a temperature range higher than 250° C., the forming ultimate height is improved. By contrast, at a high forming velocity of 70 mm/sec, the forming ultimate height is lowered as the test temperature is raised.

FIG. 10 is a graph obtained by plotting the forming ultimate height in the bulging test relatively to the forming velocity. As is understood from this graph, about the samples subjected to the bulging at a warm temperature of 350° C., the forming ultimate height is lowered as the forming velocity is increased. By contrast, about the samples subjected to the cold bulging, the forming ultimate height is not lowered very much even when the forming velocity is increased. At a forming velocity of 10 mm/sec or more, the samples subjected to the cold bulging is higher in forming ultimate height than the samples subjected to the warm bulging.

On the basis of findings obtained by such tests, in the first aspect of the invention, a press-formed member involved in deep drawing and bulging is made obtainable through press forming at a high forming velocity of 10 mm/sec or more, which can ensure high productivity, by performing at least one deep drawing step by warm working in a warm temperature range of 100 to 250° C., and performing at least one bulging step by cold working in a cold temperature range lower than 50° C. The deep drawing step defined herein is a step in which deep drawing is a majority element out of one or more forming elements. The bulging step is a step in which bulging is a majority element out of one or more forming elements.

By rendering each of the above-mentioned steel plates a steel plate containing, in a microstructure thereof, retained austenite in a proportion by volume of 3% or more, the steel plate is made good in balance between strength and ductility so that the bulging forming limit can be made better.

By rendering the steel plate containing retained austenite in the proportion by volume of 3% or more a steel plate containing, as a parent phase thereof, bainitic ferrite, the steel plate is made better in balance between strength and ductility so that the bulging forming limit can be made still better. Thus, an increase in the strength of press-formed members can be promoted, and further a scope in which the steel plate is applicable to press-formed members can be enlarged.

By causing the steel plate containing retained austenite in the proportion by volume of 3% or more to undergo the cold bulging step after the warm deep drawing step, the forming limit can be further improved in the cold bulging step.

The inventors have used a 980-MPa-class TBF steel plate containing retained austenite in a proportion by volume of 3% or more, and made a tensile test in which pre-strain by tension is given thereto at warm temperatures (at 100° C. and 200° C.) and then the steel plate is subjected to tension at a cold temperature. Result therefrom have been compared with results from a tensile test in which the same steel plate is subjected to tension at a cold or warm temperature (at 100° C. or 200° C.) without giving any pre-strain thereto about the respective total elongations. Pieces for the tensile test have each been rendered a JIS No. 13B test piece having a plate thickness of 1.4 mm, and the tensile velocity has been set to a high velocity of 17 mm/sec.

FIG. 11 shows the results of the tensile tests. According to these test results, the test pieces subjected to the tension pre-strain at the warm temperatures are each made largely better in total elongation, which includes the pre-strain, than the test pieces subjected to the cold tensile test without any pre-strain. The total elongation of the test pieces subjected to the warm tensile test without any pre-strain is lower than that of the test pieces subjected to the cold tensile test. The reason why the total elongation is improved by giving the tension pre-strain at the warm temperature would be as follows: when the pre-strain is given to the steel plate at the warm temperature of 100 or 200° C., the steel plate gains an elongation thereof by effect of only deformation of its parent phase, and subsequently at the time of subjecting the steel plate to the cold tension, the steel plate makes good use of plasticity induced transformation of retained austenite that has not been used, so that the steel can realize a high ductility. In other words, the improvement in the total elongation relative to the total elongation in the cold tensile test without any pre-strain corresponds to an elongation deformation of the parent phase that is obtained by the tension pre-strain at the warm temperature. According to such test results, about any steel plate containing retained austenite in a proportion by volume of 3% or more, it can be expected that a cold bulging step is performed therefor after a warm deep drawing step, whereby the forming limit in the cold bulging step can be further improved.

By performing the above-mentioned warm deep drawing step and the above-mentioned cold bulging step through the same press stroke, the number of press strokes (to be performed) can be made small.

On the basis of the finding obtained by the above-mentioned tests, in the second aspect of the invention, the temperature of a steel plate is set into the range of 100 to 350° C. while the steel plate is press-formed, and only the forming velocity at a late forming stage for performing bulging, in which the forming ultimate height is remarkably to be lowered by an increase in the forming velocity in such a temperature range, is made lower than the forming velocity at an earlier forming stage, which is not affected by the forming velocity. In this way, a press-formed member involved in deep drawing and bulging is made obtainable by press forming using a high tensile steel plate while the member is restrained from being declined in productivity.

The forming velocity at the late forming stage is preferably set to 10 mm/sec or less. The forming velocity at the earlier forming stage is preferably set to 10 mm/sec or more. The limit values of the forming velocities are based on the test results in FIG. 10. The bulging limit can be made better than that based on cold forming.

By rendering the steel plate a steel plate having a tensile strength of 980 MPa or more and preferably containing, in a microstructure thereof, retained austenite in a proportion by volume of 3% or more, the steel plate is made better in balance between strength and ductility so that the bulging forming limit can be made still better.

By rendering the steel plate containing retained austenite in the proportion by volume of 3% or more a steel plate containing, as a parent phase thereof, bainitic ferrite, the steel plate is made still better in balance between strength and ductility so that the bulging forming limit can be made still better. Thus, an increase in the strength of press-formed members can be promoted, and further a scope in which the steel plate is applicable to press-formed members can be enlarged.

Advantageous Effects of Invention

In the first aspect of the press forming method according to the invention for a steel plate, at least deep drawing step is performed by warm working in a warm temperature range of 100 to 250° C., and at least one bulging step is performed by cold working in a cold temperature range lower than 50° C. For this reason, a press-formed product involved in deep drawing and bulging is obtainable by press forming at a high forming velocity of 10 mm/sec or more, which can ensure high productivity.

In the second aspect of the press forming method according to the invention for a steel plate, the temperature of the steel plate is set into the range of 100 to 350° C. while the steel plate is press-formed, and the forming velocity at a late forming stage for performing the bulging is made lower than the forming velocity at an earlier forming stage in which no bulging is performed. For this reason, a press-formed member involved in deep drawing and bulging is made obtainable by press forming using a high tensile steel plate while the member is restrained from being declined in productivity. Thus, an increase in the strength of press-formed members can be promoted, and further a scope in which the steel plate is applicable to press-formed members can be enlarged.

MODE FOR CARRYING OUT INVENTION

Figure 1:
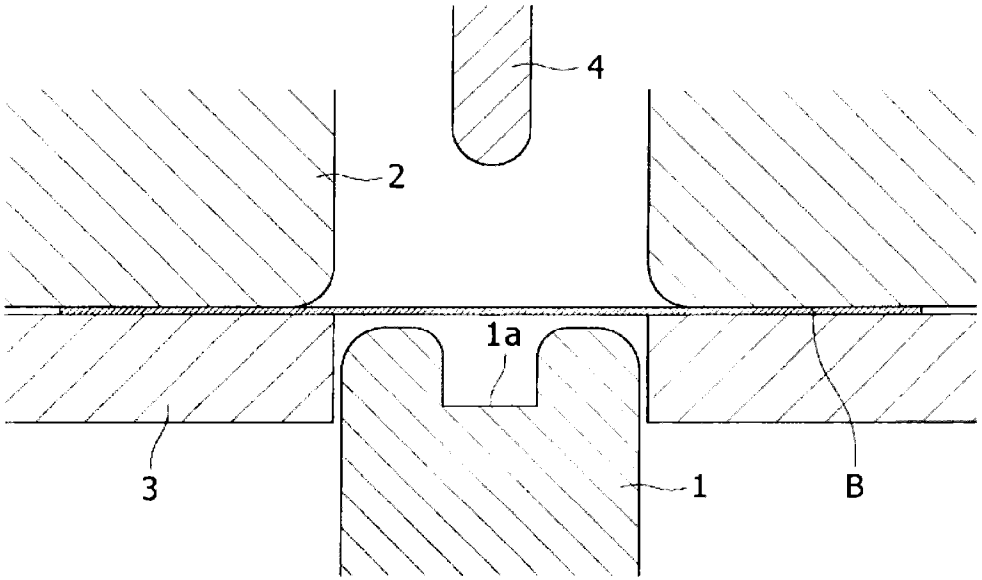
FIG. 1 is a vertical sectional view illustrating a press mold for carrying out a press forming method according to the invention for a steel plate.

Hereinafter, embodiments of the invention will be described with reference to the drawings. FIG. 1 is a press mold for carrying out a press forming method according to the invention for a steel plate. This press mold is composed of a cylindrical punch 1 directed upward and having, in a head thereof, a circular concave 1*a*; a die 2 directed downward in which the cylindrical punch 1 is to be inserted and advanced; a crease pressing plate 3 for pushing and pressing a flange of a blank B onto the die 2; and a spherical-head punch 4 directed downward to be directed to the concave 1*a* in the cylindrical punch 1. About the cylindrical punch 1, the diameter is set to 50 mm, and each of the shoulder radius thereof and the shoulder radius of the concave 1*a* to 5 mm. About the die 2, the diameter is set to 54 mm, and the shoulder radius thereof to 7 mm. About the spherical-head punch 4, the diameter is set to 10 mm.

Figure 2:
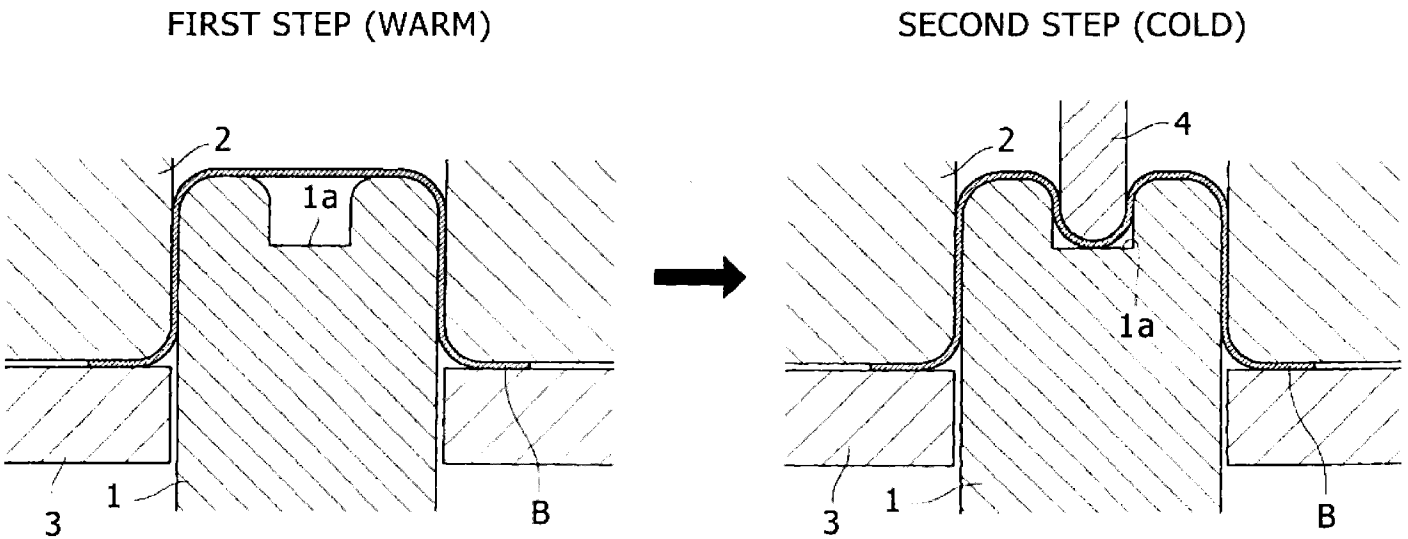
FIG. 2 is a conceptual sectional view illustrating a press forming process in a press forming method of a first embodiment.

FIG. 2 illustrates a press forming process for carrying out a press forming method of a first embodiment. This press forming process is composed of a first step of performing warm deep drawing and a second step of performing cold bulging. In the first step, the temperature of the cylindrical punch 1, the die 2 and the crease pressing plate 3 is raised to a predetermined temperature, and further the temperature of the blank B brought into contact with these press mold parts is also raised. Thereafter, the cylindrical punch 1 is inserted and advanced into the die 2 to subject the blank to warm deep drawing. About the blank B, the temperature thereof may be raised to a predetermined temperature, using a furnace or some other. In the second step, the cylindrical punch 1, the die 2, the crease pressing plate 3, and a cup-shaped semi-formed product obtained by the deep drawing are cooled to room temperature. Subsequently, the spherical-head punch 4, the temperature of which is beforehand adjusted to room temperature, is inserted and advanced into the circular concave 1*a* in the cylindrical punch 1 to subject the bottom of the cup-shaped semi-formed product to cold bulging into a concave form.

Figure 3:
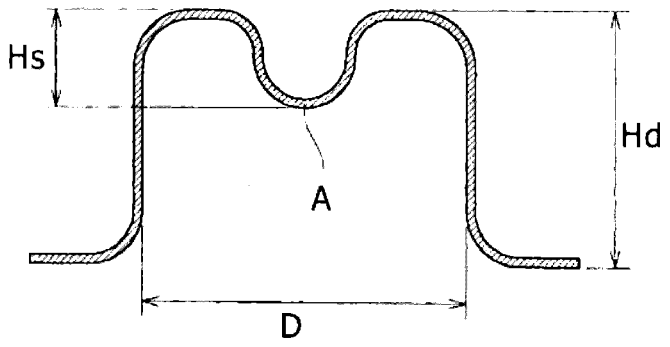
FIG. 3 is a vertical sectional view illustrating a press-molded product obtained by forming in the press forming process in FIG. 1.

FIG. 3 is a press-formed product of a steel plate that has been formed as described above. This press-formed product has, in its body, a deep-drawn bottom, and has a concave-form bulged region A obtained by bulging. About the dimension of the press-formed product, the inside diameter D thereof is set to 50 mm, and the deep drawing forming height Hd thereof to 30 mm. The bulging height Hs thereof is made variable.

WORKING EXAMPLE 1

Steel plates of four species in total were prepared, two of which were TBF steel plates, and the other two of which were DP steel plates. Table 1 shows chemical components of each of these steel plates; and Table 2 mechanical properties and microstructures thereof. The mechanical properties were gained by tensile tests using JIS No. 13B test pieces, and the proportion by volume of retained austenite in the (entire) microstructures was gained by an X-ray diffraction method. The steel plates were each a 980-MPa-class high tensile cold-drawn steel plate having a plate thickness of 1.4 mm. Each of the steel plates 1 and 2 was higher in total elongation and uniform elongation, and better in balance between strength and ductility than each of the DP steel plates 1 and 2. About the respective proportions by volume of retained austenite in the BF steel plates 1 and 2, and the DP steel plates 1 and 2, their value was decreased in this order. The proportions were each 3% or more by volume except the DP steel plate 2.

TABLE 1

| Steel plate | Chemical components (% by mass) C | Si | Mn |
|---|---|---|---|
| TBF steel plate 1 | 0.15 | 1.40 | 2.1 |
| TBF steel plate 2 | 0.17 | 1.75 | 2.4 |
| DP steel plate 1 | 0.17 | 1.3 | 1.9 |
| DP steel plate 2 | 0.09 | 1.5 | 2.1 |

TABLE 2

| High tensile steel plate | Mechanical properties (tension speed: 10 mm/min at room temperature) Yield strength (Mpa) | Breaking strength (Mpa) | Total elongation (%) | Uniform elongation (%) | Microstructures (percentage by volume) Martensite | Bainitic ferrite | Retained austenite | Polygonal ferrite |
|---|---|---|---|---|---|---|---|---|
| TBF steel plate 1 | 600 | 1010 | 15.2 | 10.3 | 9 | 81 | 10 | 0 |
| TBF steel plate 2 | 623 | 1007 | 19.5 | 13.5 | 0 | 87 | 8 | 5 |
| DP steel plate 1 | 660 | 1045 | 13.5 | 7.5 | 37 | 0 | 3 | 60 |
| Dp steel plate 2 | 680 | 1020 | 14.0 | 7.2 | 53 | 0 | 2 | 45 |

First, through the press forming process illustrated in FIG. 2, blanks from each of the TBF steel plate 1 and the DP steel plate 1 were each formed into a press-formed product as illustrated in FIG. 3. The diameter of each of the blanks was set to 103 mm. In each of the first and second steps, the forming velocity was set to 70 mm/sec. About the TBF steel plate 1, the deep drawing height Hd in the first step was set to 30 mm, and the bulging height Hs in the second step to 8 mm. About the DP steel plate 1, the deep drawing height Hd was set to 28 mm, and the bulging height Hs to 7 mm. In Examples, press forming was performed as follows (Examples A to C): the steel plate temperature of some of the blanks of each of the steel plates was varied in the range of 100 to 250° C. at each of their die contact region and their punch contact region in the first step; and in the second step, the steel plate temperature of these blanks was set to 40° C. at the die contact region, and to 25° C. at the punch contact region. In Comparative Examples, the steel plate temperature of any one of the blanks of each of the steel plates was set to 25° C. at each of the die contact region and the punch contact region so as to perform cold press forming from start to finish (Comparative Example A); and in the first step, the steel plate temperature of any one of these blanks was set to 200° C. at each of the die contact region and the punch contact region, and in the second step, the steel plate temperature of the blank was set to 350° C. at each of the die contact region and the punch contact region so as to perform warm press forming from start to finish (Comparative Example B). The pressing force of the crease pressing plate 3 onto the die 2 was set to 12 tonf in the first step, and to 20 tonf in the second step.

Tables 3(a) and 3(b) show, about each of the TBF steel plate 1 and the DP steel plate 1, press forming results of Examples and Comparative Examples. In each of the steel plates, good press forming results were obtained in each of Examples A to C. By contrast, about the two-species steels of Comparative Example A, the blanks were each cracked in the first step. Thus, the second step was unable to be performed. About the two-species steels of Comparative Example B, the blanks were able to be formed in the first step. However, in the second, the blanks were cracked. The TBF steel plate, which was good in balance between strength and ductility, was higher than the DP steel plate in each of the deep drawing height Hd in Comparative Example A, in which the blanks were unable to be formed, and the bulging height Hs in Comparative Example B.

blanks) in the first step and the respective proportions of retained austenite after the first step. The TBF steel plate 1, in which the initial proportion by volume of retained austenite was the largest, exceeded the deep drawing limit to undergo deep drawing pierce. Furthermore, the bulging height Hs in the second step was also the maximum value, which was 8 mm. About the TBF steel plate 2, in which the proportion by volume of retained austenite was the second largest, the deep drawing height Hd in the first step was 30 mm, and the bulging height Hs in the second step reached to 8 mm as the maximum value. By contrast, the deep drawing height Hd of each of the DP steel plates 1 and 2 was lower than that of the TBF steel plate 2, and the bulging height Hs thereof did not reach to 8 mm as the maximum value, either. The maximum forming load (of the steels) in the first step was decreased as the initial proportion by volume of retained austenite was increased. The TBF steel plate 1 was the lowest maximum forming load. The proportion by volume of retained austenite after the first step was also increased as the initial proportion by volume of retained austenite was increased.

TABLE 3(a)

| | (First step) Hd = 30 mm | | | | (Second step) Hs = 8 mm | | | |
|---|---|---|---|---|---|---|---|---|
| | Steel plate temperature (° C.) | | | | Steel plate temperature (° C.) | | | Reduction of |
| | Die contact region | Punch contact region | Able or unable to be formed | | Die contact region | Punch contact region | Able or unable to be formed | plate thickness of bulged region |
| Example A | 200 | 200 | ○ | → | 40 | 25 | ○ | 19% |
| Example B | 100 | 250 | ○ | → | 40 | 25 | ○ | — |
| Example C | 250 | 100 | ○ | → | 40 | 25 | ○ | — |
| Comparative Example A | 25 | 25 | X: Hd = 22 | → | 25 | 25 | Unable | — |
| Comparative Example B | 200 | 200 | ○ | → | 350 | 350 | X: Hs = 6 | — |

TABLE 3(b)

| | (First step) Hd = 28 mm | | | | (Second step) Hs = 7 mm | | |
|---|---|---|---|---|---|---|---|
| | Steel plate temperature (° C.) | | | | Steel plate temperature (° C.) | | |
| | Die contact region | Punch contact region | Able or unable to be formed | | Die contact region | Punch contact region | Able or unable to be formed |
| Example A | 200 | 200 | ○ | → | 40 | 25 | ○ |
| Example B | 100 | 250 | ○ | → | 40 | 25 | ○ |
| Example C | 250 | 100 | ○ | → | 40 | 25 | ○ |
| Comparative Example A | 25 | 25 | X: Hd = 20 | → | 25 | 25 | Unable |
| Comparative Example B | 200 | 200 | ○ | → | 350 | 350 | X: Hs = 5 |

Next, a blank having a diameter of 103 mm and sampled from each of the TBF steel plates 1 and 2 and the DP steel plates 1 and 2 was used, and subjected to press forming under conditions that the steel plate temperature in deep drawing in the (same) first step (as described above) was set to 200° C. and that in bulging in the (same) second step (as described above) to 25° C., so as to form this blank up to forming limit about the deep drawing height Hd and the bulging height Hs in the respective steps. The bulging height Hs in the second step was set to 8 mm as a maximum value. The pressing force of the crease pressing plate 3 onto the die 2 was set to 12 tonf in the first step, and to 20 tonf in the second step.

Results of the press forming are shown in Table 4. Table 4 also shows the respective maximum forming loads (of the

TABLE 4

| | First step | | | Second |
|---|---|---|---|---|
| Steel plate | Ultimate forming height Hd (mm) | Maximum forming load (KN) | Proportion (% by volume) of retained austenite after the step | step Ultimate forming height Hs (mm) |
| TBF steel plate 1 | Deep drawing pierce | 115 | 9.7 | 8 |
| TBF steel plate 2 | 30 | 140 | 5.4 | 8 |
| DP steel plate 1 | 28 | 155 | 2.5 | 7 |
| DP steel plate 2 | 26 | 160 | 1.7 | 6 |

Figure 4:
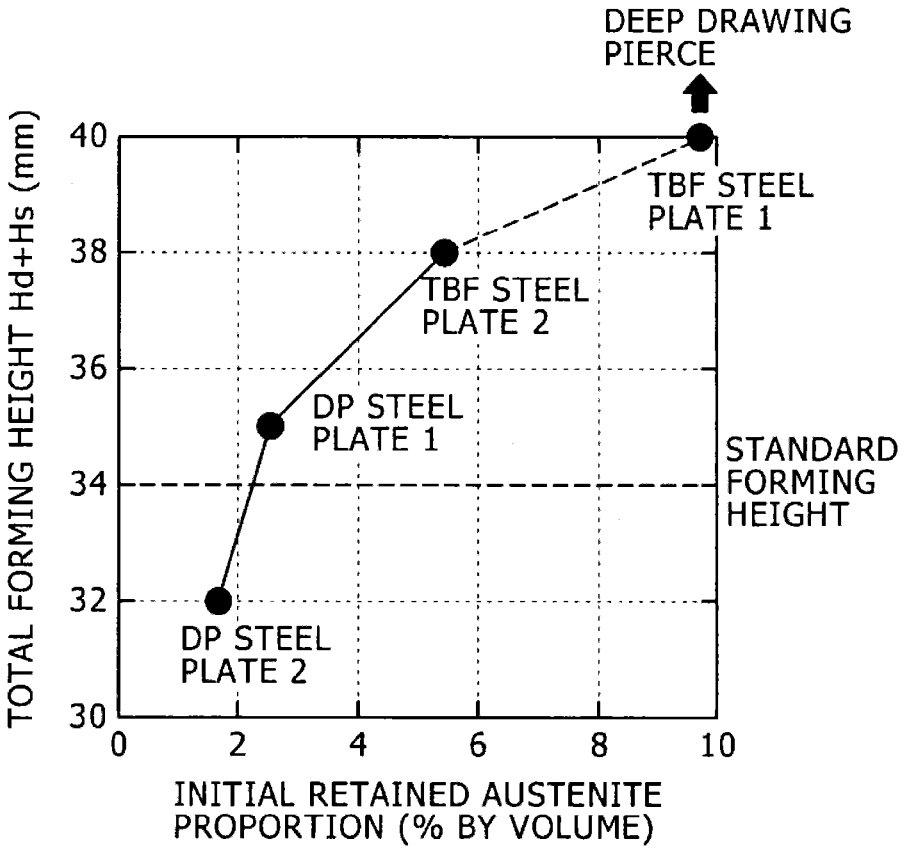
FIG. 4 is a graph showing a relationship between the total forming height and the initial retained austenite proportion when the forming in each step in the press forming process in FIG. 1 is performed up to forming limit.

FIG. 4 is a graph obtained by plotting the total forming height "Hd+Hs" of the deep drawing height Hd in the first step and the bulging height Hs in the second step, which are each shown in Table 4, relatively to the initial proportion by volume of retained austenite. A standard forming height shown in the graph is the total forming height "Hd+Hs" (26+8=34 mm) when a 590-MP-class high tensile steel plate (total elongation: 25%) was cold press-formed in both of the first and second steps. From this graph, the following are understood: the total forming height "Hd+Hs" in the first and second steps becomes higher as the initial proportion by volume of retained austenite is larger; and in the case of the press forming when the initial proportion by volume of retained austenite turns into 3% or more by volume, the forming limit is made better than in the case where the 590-MP-class high tensile steel plate, which is far lower in strength, is cold press-formed.

Figure 5:
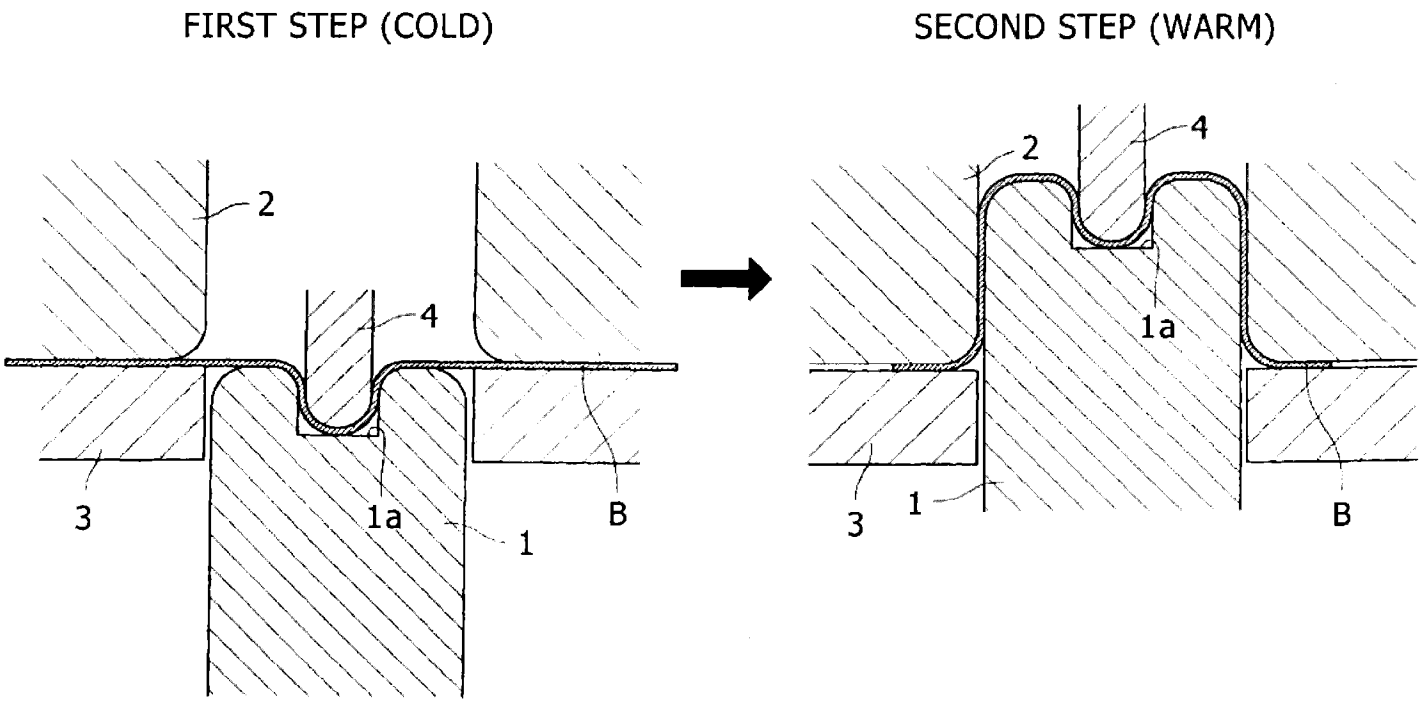
FIG. 5 is a conceptual sectional view illustrating a press forming process in a press forming method of a second embodiment.

FIG. 5 illustrates a press forming process for carrying out a press forming method of a second embodiment. This press forming process is composed of a first step of performing cold bulging and a second step of performing warm deep drawing. A press machine and a press mold used therein were the same as in the first embodiment. According to this embodiment, in the first step, the temperature of the cylindrical punch 1, the die 2, the crease pressing plate 3 and the spherical-head punch 4 is set to room temperature, and at the center of a blank B sandwiched between the die 2 and the crease pressing plate 3, the spherical-head punch 4 is inserted and advanced into the circular concave 1*a* in the cylindrical punch 1 to bulge the blank. In the second step, the temperature of the cylindrical punch 1, the die 2, the crease pressing plate 3 and the spherical-head punch 4 is raised to a predetermined temperature, and further the temperature of the blank B brought into contact with these press mold parts is also raised. Thereafter, the cylindrical punch 1 is inserted and advanced into the die 2 to bulge the blank.

WORKING EXAMPLE 2

First, through the press forming process illustrated in FIG. 5, blanks from each of the TBF steel plate 1 and the DP steel plate 1 shown in Tables 1 and 2 were each formed into a press-formed product as illustrated in FIG. 3. The diameter of each of the blanks was set to 103 mm. In each of the steps, the forming velocity was set to 70 mm/sec. About the TBF steel plate 1, the bulging height Hs in the first step was set to 8 mm, and the deep drawing height Hd in the second step to 30 mm. About the DP steel plate 1, the bulging height Hs was set to 7 mm, and the deep drawing height Hd to 28 mm. In Examples, press forming was performed as follows (Examples D to F): in the first step, the steel plate temperature of some of the blanks of each of the steel plates was set to 25° C. at each of their die contact region and their punch contact region; and in the second step, the steel plate temperature of these blanks was varied in the range of 100 to 250° C. at each of the die contact region and the punch contact region. In Comparative Examples, in each of the first and second steps, the steel plate temperature of any one of the blanks of each of the steel plates was set to 25° C. at each of its die contact region and its punch contact region so as to perform cold press forming from start to finish (Comparative Example C); and in the first step, the steel plate temperature of any one of these blanks was set to 350° C. at each of the die contact region and the punch contact region, and in the second step, the steel plate temperature of the blank was set to 200° C. at each of the die contact region and the punch contact region so as to perform warm press forming from start to finish (Comparative Example D). In each of these cases, the pressing force of the crease pressing plate 3 onto the die 2 was set to 12 tonf in the first step, and to 20 tonf in the second step.

Tables 5(a) and 5(b) show, about each of the steel plates, press forming results of Examples and Comparative Examples. In each of the TBF steel plate 1 and the DP steel plate 1, good press forming results were obtained in each of Examples D to F. By contrast, about the two-species steels of Comparative Example C, the blanks were able to be formed in the first step. However, in the second, the blanks were cracked. About the two-species steels of Comparative Example D, the blanks were cracked in the first step. Thus, the second step was unable to be performed. The TBF steel plate 1, which was good in balance between strength and ductility, was higher than the DP steel plate 1 in each of the deep drawing height Hd in Comparative Example C, in which the blanks were unable to be formed, and the bulging height Hs in Comparative Example D.

TABLE 5(a)

| | (First step) Hs = 8 mm | | | | (Second step) Hd = 30 mm | | | |
|---|---|---|---|---|---|---|---|---|
| | Steel plate temperature (° C.) | | | | Steel plate temperature (° C.) | | | Reduction of |
| | Die contact region | Punch contact region | Able or unable to be formed | | Die contact region | Punch contact region | Able or unable to be formed | plate thickness of bulged region |
| Example D | 25 | 25 | ○ | → | 200 | 200 | ○ | 24% |
| Example E | 25 | 25 | ○ | → | 100 | 250 | ○ | — |
| Example F | 25 | 25 | ○ | → | 250 | 100 | ○ | — |
| Comparative Example C | 25 | 25 | ○ | → | 25 | 25 | X: Hd = 21 | — |
| Comparative Example D | 350 | 350 | X: Hs = 6 | → | 200 | 200 | Unable | — |

TABLE 5(b)

| | (First step) Hs = 7 mm | | | | (Second step) Hd = 28 mm | | |
|---|---|---|---|---|---|---|---|
| | Steel plate temperature (° C.) | | | | Steel plate temperature (° C.) | | |
| | Die contact region | Punch contact region | Able or unable to be formed | | Die contact region | Punch contact region | Able or unable to be formed |
| Example D | 25 | 25 | ○ | → | 200 | 200 | ○ |
| Example E | 25 | 25 | ○ | → | 100 | 250 | ○ |

TABLE 5(b)-continued

| | (First step) Hs = 7 mm | | | | (Second step) Hd = 28 mm | | |
|---|---|---|---|---|---|---|---|
| | Steel plate temperature (° C.) | | | | Steel plate temperature (° C.) | | |
| | Die contact region | Punch contact region | Able or unable to be formed | | Die contact region | Punch contact region | Able or unable to be formed |
| Example F | 25 | 25 | ○ | → | 250 | 100 | ○ |
| Comparative Example C | 25 | 25 | ○ | → | 25 | 25 | X: Hd = 20 |
| Comparative Example D | 350 | 350 | X: Hs = 5 | → | 200 | 200 | Unable |

According to the aforementioned press forming results of Example 1 and Example 2, the press forming method according to the invention, in which a deep drawing step is performed by warm working at 100 to 250° C., and a bulging step is performed by cold working at a temperature lower than 50° C., makes it possible to give good press forming results at a high forming velocity, which can ensure high productivity, even when a high tensile steel plate is used. Thus, the invention makes it possible to promote an increase in the strength of press-formed members and further enlarge a scope in which a high tensile steel plate is applicable to press-formed members.

Figure 11:
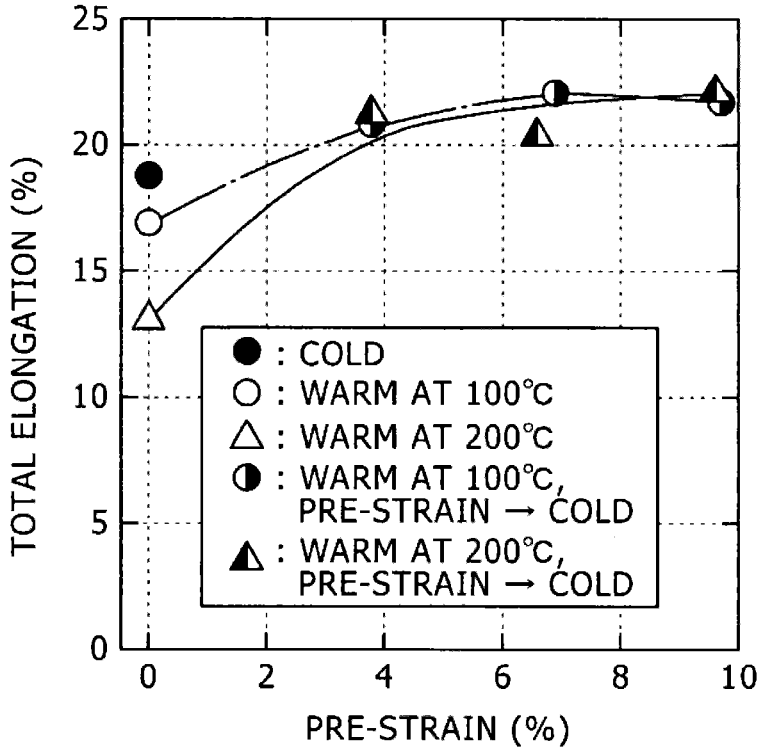
FIG. 11 is a graph showing results of a tensile test in which a pre-strain is given at a warm temperature.

In Tables 3(a) and 5(a) showing the press forming results of the TBF steel plate 1, the following are also shown about Examples A and D, respectively, in which the steel plate temperature of each of the die contact region and the punch contact region was set to 200° C. in the warm deep drawing: results obtained by measuring the respective plate thickness reductions of the press-formed products at the center of their bulged region A. In Example A, in which the cold bulging step was performed after the warm deep drawing step, the steel plate thickness reduction of the bulged region A was about 5% smaller than that in Example D, in which the cold bulging step was performed before the warm deep drawing step. Thus, it can be expected that the forming limit is heightened. The measurement results of the steel plate thickness reductions correspond sufficiently to the tensile test results shown in FIG. 11. It appears that in Example A, the steel gains an elongation thereof by effect of only deformation of its parent phase in the deep drawing in the first step, and makes good use of plasticity induced transformation of retained austenite that has not been used, so that the steel can realize a high ductility.

Figure 6:
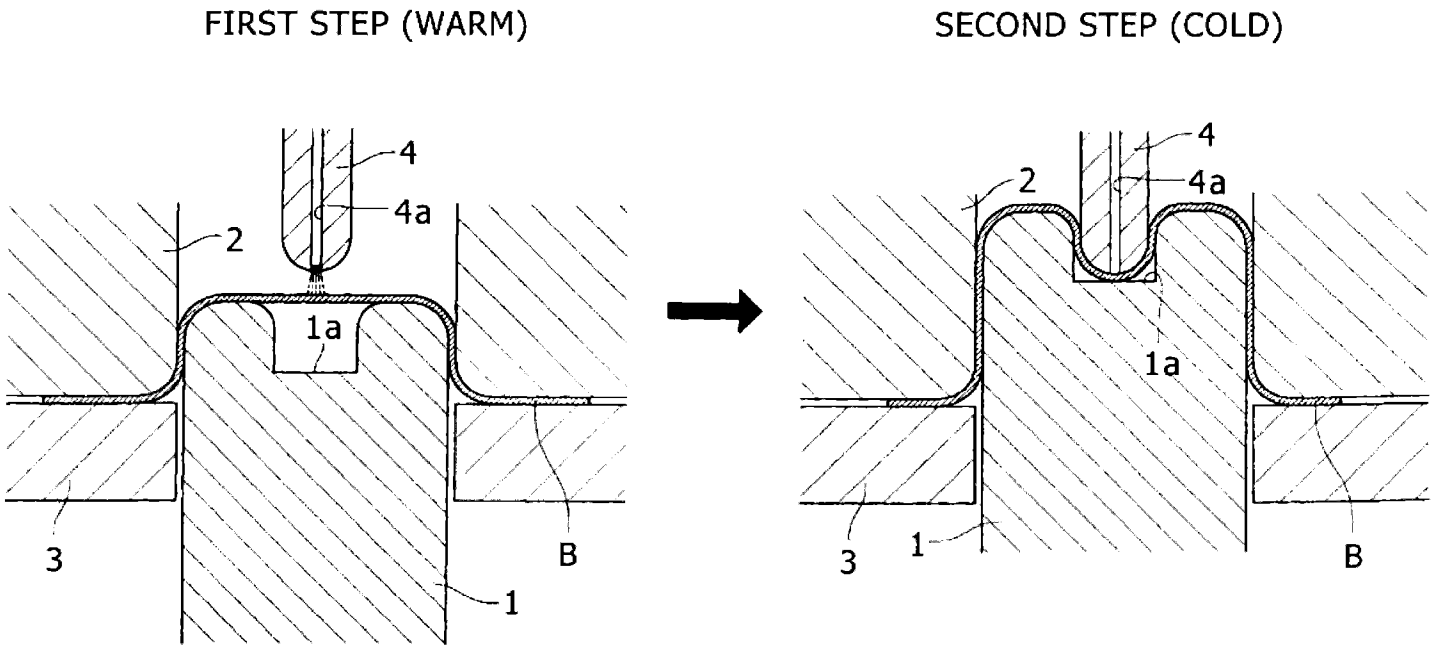
FIG. 6 is a conceptual sectional view illustrating a press forming process in a press forming method of a third embodiment.

FIG. 6 illustrates a press forming process for carrying out a press forming method of a third embodiment. In this press forming process, a first step of performing warm deep drawing and a second step of performing cold bulging are performed through the same press stroke. A press machine and a press mold used therein were the same as in the first embodiment. However, a spherical-head punch 4 for performing the bulging is a punch having, in the top thereof, a coolant jetting-out outlet 4*a*. The coolant may be air, water, oil or the like.

In this embodiment, the temperature of the cylindrical punch 1, the die 2 and the crease pressing plate 3 is raised while the temperature of a blank B brought into contact with these press mold parts is also raised. Thereafter, at an earlier stage of a pre-stroke as the first step, the cylindrical punch 1 is inserted and advanced into the die 2 to subject the blank to warm deep drawing at a temperature ranging from 100 to 250° C.; and at the late stage of the pre-stroke as the second step, the coolant is jetted out from the jetting-out outlet 4*a* to cool the bottom of a cup-shaped semi-formed product obtained by the deep drawing. This bottom is subjected to cold bulging into a concave form at a temperature lower than 50° C. The coolant for cooling the bottom of the cup-shaped semi-formed product may be jetted out from the cylindrical punch 1.

Figure 7:
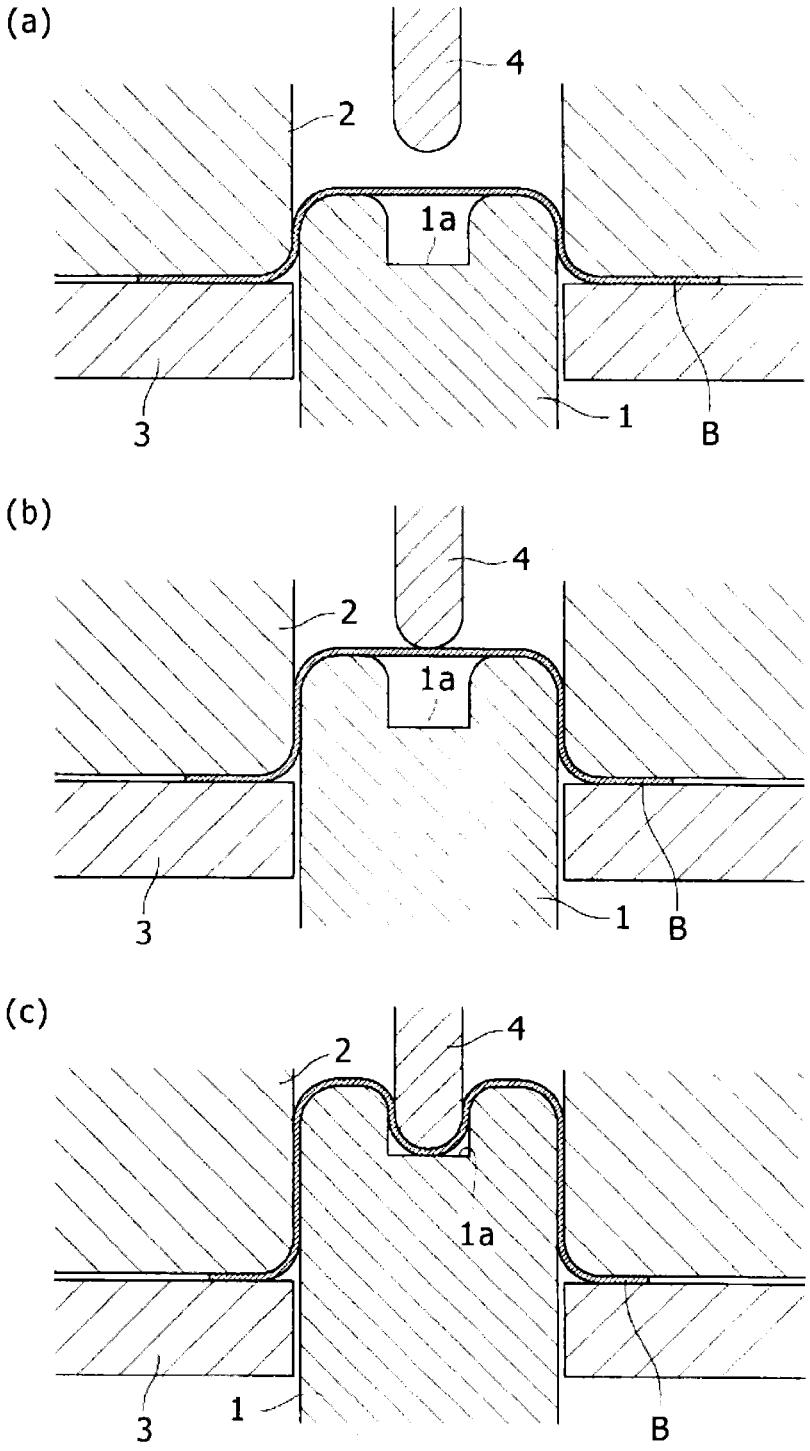
FIGS. 7(*a*), 7(*b*) and 7(*c*) are sectional views illustrating a press forming process in a press forming method of a fourth embodiment.
Figure 8:
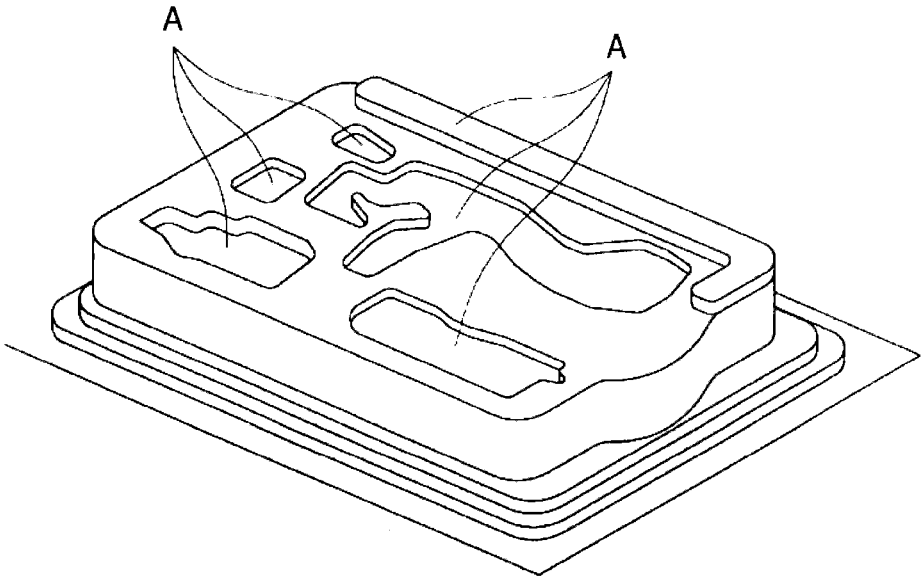
FIG. 8 is an external appearance perspective view illustrating an example of a press-formed member involved in deep drawing and bulging.
Figure 9:
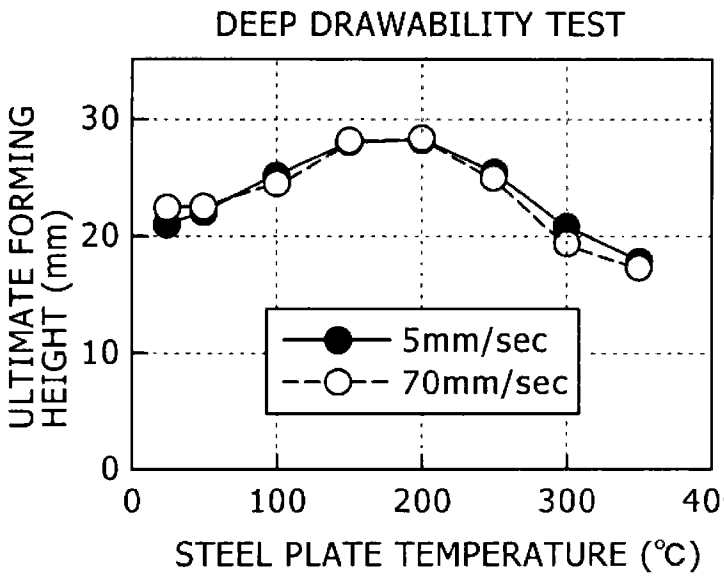
FIGS. 9(*a*) and 9(*b*) are graphs showing results of a deep drawing test and a bulging test, respectively.
Figure 9:
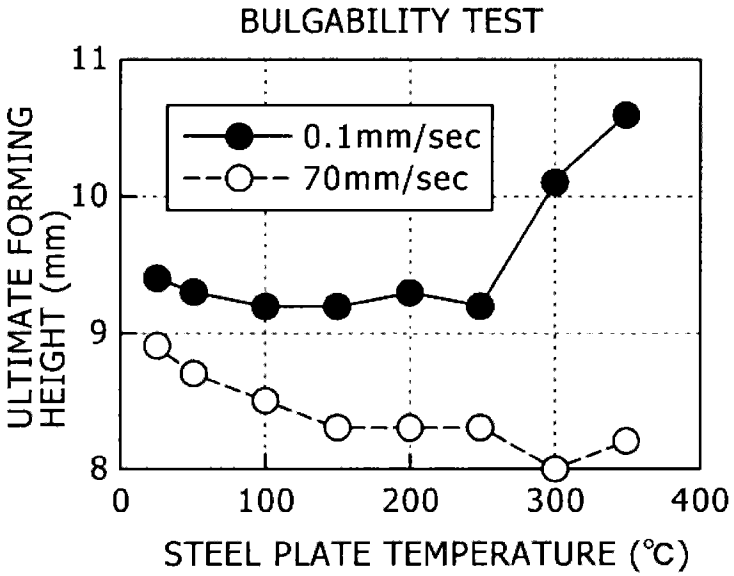
Figure 10:
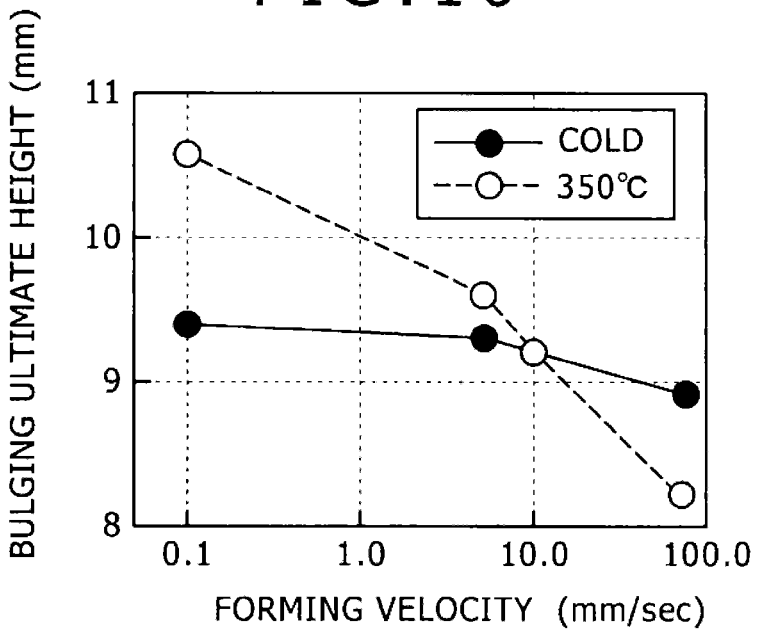
FIG. 10 is a graph showing a relationship between the forming velocity and the forming ultimate height in the bulging test in FIG. 6(*b*).

FIG. 7 illustrate a process of using the press mold to press-form the blank B. As illustrated in FIG. 7(*a*), first, the cylindrical punch 1 is inserted and advanced into the die 2, so that the material of a flange region of the blank flows into the die 2 to start deep forming. The resultant deep drawing height increases as the forming is advanced, so that the spherical-head punch 4 is brought into contact with the material of the head of the spherical-head punch 4 as illustrated in FIG. 7(*b*). When the forming is further advanced, the deep drawing height further increases and additionally the material of the head of the cylindrical punch 1 is bulged into the circular concave 1*a* in the cylindrical punch 1 by effect of the spherical-head punch 4, as illustrated in FIG. 7(*c*).

WORKING EXAMPLE 3

Blanks from each of the TBF steel plate 2 and the DP steel plates 1 and 2, which were of three species in total, shown in Tables 1 and 2 were each set into the press mold illustrated in FIG. 1 to form a press-formed product illustrated in FIG. 3. The diameter of each of the blanks was set to 103 mm. The bulging height Hs was set to 8 mm. At the time of the press forming, the steel plate temperature θ of the blanks was varied from room temperature to 350° C. in the press forming. The steel plate temperature θ in the press forming was certainly kept by bringing the blanks into contact, for a predetermined period, with the press mold the temperature of which was raised to predetermined individual temperatures. The temperature of the blanks may be raised to the predetermined temperatures, using a furnace or the like in advance. At the earlier forming stage (S=0 to 22 mm) in which only the deep drawing was performed, the forming velocity V1 of the blanks was set to a high velocity of 70 mm/sec, which was regarded as an actual forming velocity in actual press factories, and the forming velocity V2 of the blank at the late forming stage (S=22 to 30 mm) was varied from 0.1 to 70 mm/sec. About some of the blanks, the forming velocity V1 at the earlier forming stage was also varied. The pressing force of the crease pressing plate 3 onto the die 2 was set to 12 tonf in the course from FIG. 7(*a*) to FIG. 7(*b*) in the first step, and to 20 tonf in the course from FIG. 7(*b*) to FIG. 7(*c*).

Tables 6(a), 6(b) and 6(c) show, about each of the TBF steel plate 2 and the DP steel plates 1 and 2, press forming results when the steel plate temperature θ was set to 200° C. About the DP steel plate 1, in which the proportion by volume of retained austenite is 3% by volume, the steel plate becomes able to be formed when the forming velocity V2 at the late forming stage is set to 2.5 mm/sec or less. About the DP steel plate 2, in which the proportion by volume of retained austenite is 2% by volume, the steel plate becomes able to be formed when the forming velocity V2 at the late forming stage is set to an extremely low value of 0.1 mm/sec. By contrast, about the TBF steel plate 2, in which the proportion by volume of retained austenite is 8% by volume and the balance between the strength and the ductility thereof is better, the steel plate becomes able to be formed when the forming velocity V2 at the late forming stage is set to 10 mm/sec or less. In each of the cases of making the forming velocity V2 higher than these ultimate velocities, the bulged region A was cracked so that the blank was unable to be formed. Accordingly, it can be expected that at the late forming stage any steel plate in which the proportion by volume of retained austenite is 3% or more by volume can be bulged at a velocity permitting formed products not to be lowered very much in productivity.

TABLE 6(a)

| Steel plate temperature θ (° C.) | Forming velocity V1 (mm/sec) | Forming velocity V2 (mm/sec) | Able or unable to be formed |
|---|---|---|---|
| 200 | 70 | 70 | X |
| 200 | 70 | 15 | X |
| 200 | 70 | 12 | X |
| 200 | 70 | 10 | ○ |
| 200 | 70 | 5 | ○ |
| 200 | 70 | 2.5 | ○ |
| 200 | 70 | 0.1 | ○ |
| 200 | 15 | 10 | ○ |
| 200 | 12 | 10 | ○ |

TABLE 6(b)

| Steel plate temperature θ (° C.) | Forming velocity V1 (mm/sec) | Forming velocity V2 (mm/sec) | Able or unable be formed |
|---|---|---|---|
| 200 | 70 | 70 | X |
| 200 | 70 | 15 | X |
| 200 | 70 | 12 | X |
| 200 | 70 | 10 | X |
| 200 | 70 | 5 | X |
| 200 | 70 | 2.5 | ○ |
| 200 | 70 | 0.1 | ○ |
| 200 | 15 | 2.5 | ○ |
| 200 | 12 | 2.5 | ○ |

TABLE 6(c)

| Steel plate temperature θ (° C.) | Forming velocity V1 (mm/sec) | Forming velocity V2 (mm/sec) | Able or unable to be formed |
|---|---|---|---|
| 200 | 70 | 70 | X |
| 200 | 70 | 15 | X |
| 200 | 70 | 12 | X |
| 200 | 70 | 10 | X |
| 200 | 70 | 5 | X |
| 200 | 70 | 2.5 | X |
| 200 | 70 | 0.1 | ○ |
| 200 | 15 | 0.1 | ○ |
| 200 | 12 | 0.1 | ○ |

Tables 7(a) and 7(b) show, about each of the TBF steel plate 2 and the DP steel plate 1, press forming results when the steel plate temperature θ of the blanks thereof was varied. The forming velocity V1 at the earlier forming stage and the forming velocity V2 at the late forming stage were set as follows: V1=70 mm/sec, and V2=10 mm/sec about the TBF steel plate 1; and V1=70 mm/sec, and V2=2.5 mm/sec about the DP steel plate 1. In each Comparative Example, V1 and V2 were each set to 70 mm to make the forming velocity high in the whole of the forming stages, and results of this press forming are also shown.

TABLE 7(a)

| Steel plate temperature θ (° C.) | Forming velocity V1 (mm/sec) | Forming velocity V2 (mm/sec) | Able or unable to be formed | |
|---|---|---|---|---|
| Room temperature | 70 | 10 | X | Comparative Example |
| 100 | 70 | 10 | ○ | Example |
| 150 | 70 | 10 | ○ | Example |
| 200 | 70 | 10 | ○ | Example |
| 250 | 70 | 10 | ○ | Example |
| 300 | 70 | 10 | ○ | Example |
| 350 | 70 | 10 | ○ | Example |
| Room temperature | 70 | 70 | X | Comparative Example |
| 100 | 70 | 70 | X | Comparative Example |
| 150 | 70 | 70 | X | Comparative Example |
| 200 | 70 | 70 | X | Comparative Example |
| 250 | 70 | 70 | X | Comparative Example |
| 300 | 70 | 70 | X | Comparative Example |
| 350 | 70 | 70 | X | Comparative Example |

TABLE 7(b)

| Steel plate temperature θ (° C.) | Forming velocity V1 (mm/sec) | Forming velocity V2 (mm/sec) | Able or unable to be formed | |
|---|---|---|---|---|
| Room temperature | 70 | 2.5 | X | Comparative Example |
| 100 | 70 | 2.5 | ○ | Example |
| 150 | 70 | 2.5 | ○ | Example |
| 200 | 70 | 2.5 | ○ | Example |
| 250 | 70 | 2.5 | ○ | Example |
| 300 | 70 | 2.5 | ○ | Example |
| 350 | 70 | 2.5 | ○ | Example |
| Room temperature | 70 | 70 | X | Comparative Example |
| 100 | 70 | 70 | X | Comparative Example |
| 150 | 70 | 70 | X | Comparative Example |
| 200 | 70 | 70 | X | Comparative Example |
| 250 | 70 | 70 | X | Comparative Example |
| 300 | 70 | 70 | X | Comparative Example |
| 350 | 70 | 70 | X | Comparative Example |

According to these press forming results, about the TBF steel plate 2 and the DP steel plate 1, the blanks of Examples, in which the steel plate temperature θ was set into the range of 100 to 350° C. and the forming velocity V2 was set to low velocities of 2.5 mm/s and 10 mm/s, respectively, were each able to be formed. About the blanks of Comparative Examples, in which the forming velocity was made high (70 mm/sec) at the whole of the forming stages, their bulged region A was cracked even when the steel plate temperature θ was set into the range of 100 to 350° C. Thus, these blanks were unable to be formed.

According to the aforementioned press forming results, the following can be attained by the steel plate forming method according to the invention, in which while a steel plate is press-formed, the steel plate temperature is set into the range of 100 to 300° C. and the forming velocity at a late forming stage for performing bulging is made lower than the forming velocity at an earlier forming stage in which no bulging is performed: the forming limit of a press-formed product involved in deep drawing and bulging, which is not easily obtained by any forming, is made remarkably high. Thus, the invention makes it possible to promote an increase in the strength of press-formed members and further enlarge a scope in which a high tensile steel plate is applicable to press-formed members.

Tables 8(a) and 8(b) show, about each of the TBF steel plate 2 and the DP steel plate 1, results of an examination in which, at the press forming time, the steel plate temperature θ1 of respective flange regions (of the blanks of the steel plate) and the steel plate temperature θ2 of respective bulged regions A thereof were separately varied to examine as to whether or not the blanks were able to be press-formed, and respective plate thickness reductions of the bulged regions A. A combination of the forming velocity V1 at the earlier forming stage with the forming velocity V2 at the late forming stage was set as follows: V1=70 mm/sec, and V2=10 mm/sec about the TBF steel plate 2; and V1=70 mm/sec, and V2=2.5 mm/sec about the DP steel plate 1. A combination of the steel plate temperature θ1 of the flange regions with that θ2 of the bulged regions A is set into two species, one of which was a species of making the steel plate temperature θ1 constant, 200° C., and varying the steel plate temperature θ2 in the range of 100 to 400° C., and the other of which was a species of making the steel plate temperature θ2 constant, 350° C., and varying the steel plate temperature θ1 in the range of 100 to 400° C. In each Comparative Example, an examination was made in the state that the two steel plate temperatures θ1 and θ2 were each set to room temperature. Results thereof are also shown.

TABLE 8(a)

| Forming velocity V1→V2 (mm/sec) | Steel plate temperature θ1 (° C.) | Steel plate temperature θ2 (° C.) | Able or unable to be formed | Reduction (%) of plate thickness | |
|---|---|---|---|---|---|
| 70→10 | Room temperature | Room temperature | X | — | Comparative Example |
| 70→10 | 200 | 100 | ○ | 18 | Example |
| 70→10 | 200 | 150 | ○ | 18 | Example |
| 70→10 | 200 | 200 | ○ | 17 | Example |
| 70→10 | 200 | 250 | ○ | 16 | Example |
| 70→10 | 200 | 300 | ○ | 13 | Example |
| 70→10 | 200 | 350 | ○ | 12 | Example |
| 70→10 | 200 | 400 | X | — | Comparative Example |
| 70→10 | 100 | 350 | ○ | 14 | Example |
| 70→10 | 150 | 350 | ○ | 13 | Example |
| 70→10 | 250 | 350 | ○ | 14 | Example |
| 70→10 | 300 | 350 | ○ | 16 | Example |
| 70→10 | 350 | 350 | ○ | 17 | Example |
| 70→10 | 400 | 350 | X | — | Comparative Example |
| 70→10 | 400 | 400 | X | — | Comparative Example |

TABLE 8(b)

| Forming velocity V1→V2 (mm/sec) | Steel plate temperature θ1 (° C.) | Steel plate temperature θ2 (° C.) | Able or unable to be formed | Reduction (%) of plate thickness | |
|---|---|---|---|---|---|
| 70→2.5 | Room temperature | Room temperature | X | — | Comparative Example |
| 70→2.5 | 200 | 100 | ○ | 20 | Example |
| 70→2.5 | 200 | 150 | ○ | 20 | Example |
| 70→2.5 | 200 | 200 | ○ | 19 | Example |
| 70→2.5 | 200 | 250 | ○ | 18 | Example |
| 70→2.5 | 200 | 300 | ○ | 15 | Example |
| 70→2.5 | 200 | 350 | ○ | 14 | Example |
| 70→2.5 | 200 | 400 | X | — | Comparative Example |
| 70→2.5 | 100 | 350 | ○ | 17 | Example |
| 70→2.5 | 150 | 350 | ○ | 15 | Example |
| 70→2.5 | 250 | 350 | ○ | 16 | Example |
| 70→2.5 | 300 | 350 | ○ | 18 | Example |
| 70→2.5 | 350 | 350 | ○ | 20 | Example |
| 70→2.5 | 400 | 350 | X | — | Comparative Example |

According to the examination results shown in Tables 8(a) and 8(b), about each of the TBF steel plate 2 and the DP steel plate 1, the blanks of Examples, in which the steel plate temperatures θ1 and θ2 were combined with each other in the range of 150 to 300° C., are able to be formed. The steel plate thickness reduction of their bulged region A is as follows: the reduction of the TBF steel plate 2, which is good in balance between strength and ductility, is smaller than that of the DP steel plate 1. In particular, in the cases of setting the steel plate temperature θ1 of the flange regions and the steel plate temperature θ2 of the bulged regions A to 200° C. and 350° C., respectively, the steel plate thickness reduction is the smallest, i.e., 12% about the TBF steel plate and 14% about the DP steel plate 1. Thus, these temperature conditions can be expected to be optimal temperature conditions capable of improving the forming limit of a press-formed product that is more difficult to obtain. It can be presumed that the reason why the blanks of the Comparative Examples in which either one of the steel plate temperatures θ1 and θ2 was set to 400° C. were unable to be formed is that retained austenite was decomposed at 400° C. so that the TRIP effect was restrained from being produced so that the blanks were lowered in ductility.

In each of the above-mentioned embodiments, the deep drawing step and the bulging step are each performed once. However, the press forming method according to the invention may be a method in which either one of these steps is performed two or more times, or a method including any other step, such as a stretch flanging step, a bending step, and/or a punching step. About the punching-step-including method, it can be expected that a load for the punching is decreased by performing the punching step simultaneously with a warm deep drawing step.

In the above-mentioned working examples, the steel plates were rendered 980-MPa-class TBF steel plates and DP steel plates. However, a target of the application of the steel-plate-press-forming method according to the invention is not limited to such 980-MPa-class DP steel plates or TBF steel plates. The method may be applied to a steel plate of any steel type and in any strength-class, an example thereof being a mild steel plate.

In the working examples, the earlier forming stage, in which only deep drawing is performed, and the late forming stage, in which bulging is performed, are attained through the same press forming process. However, the earlier forming stage and the late forming stage may be attained through different separated press forming processes.

REFERENCE SIGNS LIST

A: bulged region,
B: blank,
1: cylindrical punch,
1*a*: concave,
2: die,
3: crease pressing plate,
4: spherical-head punch, and
4*a*: coolant jetting-out outlet

The invention claimed is:

1. A press forming method for a steel plate, comprising:

at least one deep drawing step and at least one bulging step, a forming velocity for the press forming in each of these forming steps being set to 10 mm/sec or more, wherein the deep drawing step, which is at least one in number, is performed by warm working in a warm temperature range of 100 to 250° C., and the bulging step, which is at least one in number, is performed by cold working in a cold temperature range lower than 50° C.

2. The press forming method for a steel plate according to claim 1, wherein the steel plate is a steel plate containing, in a microstructure thereof, retained austenite in a proportion by volume of 3% or more.

3. The press forming method for a steel plate according to claim 2, wherein the steel plate containing retained austenite in the proportion by volume of 3% or more is a steel plate containing, as a parent phase thereof, bainitic ferrite.

4. The press forming method for a steel plate according to claim 1, wherein the cold bulging step is performed after the warm deep drawing step.

5. The press forming method for a steel plate according to claim 1, wherein the warm deep drawing step and the cold bulging step are performed through the same press stroke.

6. The press forming method for a steel plate according to claim 1, further comprising a step of heating at least one element performing the deep drawing step prior to the deep drawing step.

7. The press forming method for a steel plate according to claim 1, wherein the forming velocity for the press forming in each of the forming steps being set to 70 mm/sec.

* * * * *